US010900151B2

(12) United States Patent
Yoshida

(10) Patent No.: US 10,900,151 B2
(45) Date of Patent: Jan. 26, 2021

(54) LEG PRODUCT

(71) Applicant: Asahi Kasei Kabushiki Kaisha, Tokyo (JP)

(72) Inventor: Yuji Yoshida, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 117 days.

(21) Appl. No.: 16/339,323

(22) PCT Filed: Oct. 11, 2017

(86) PCT No.: PCT/JP2017/036862
§ 371 (c)(1),
(2) Date: Apr. 3, 2019

(87) PCT Pub. No.: WO2018/070439
PCT Pub. Date: Apr. 19, 2018

(65) Prior Publication Data

US 2019/0230998 A1 Aug. 1, 2019

(30) Foreign Application Priority Data

Oct. 13, 2016 (JP) ..... 2016-202098

(51) Int. Cl.
*D04B 1/26* (2006.01)
*A41B 11/14* (2006.01)
(Continued)

(52) U.S. Cl.
CPC ..... *D04B 1/26* (2013.01); *A41B 9/02* (2013.01); *A41B 9/04* (2013.01); *A41B 11/00* (2013.01);
(Continued)

(58) Field of Classification Search
CPC .. D04B 1/26; D04B 1/18; D04B 1/243; A41B 11/00; A41B 11/14; A41B 9/02; A41B 9/04
See application file for complete search history.

(56) References Cited

U.S. PATENT DOCUMENTS 5,640,714 A * 6/1997 Tanaka ..... A41B 11/00 2/22
9,526,651 B2 * 12/2016 Kozasa ..... A41D 13/0543
(Continued)

FOREIGN PATENT DOCUMENTS

JP S63-243305 A 10/1988
JP S63-243306 A 10/1988
(Continued)

OTHER PUBLICATIONS

Supplementary European Search Report issued in corresponding European Patent Application No. 17860612.5 dated Sep. 27, 2019.
(Continued)

*Primary Examiner* — Danny Worrell
(74) *Attorney, Agent, or Firm* — Morgan, Lewis &. Bockius LLP

(57) ABSTRACT

This leg product comprising a tubular knitted fabric, in which the entire course of a leg part is knitted in a jersey stitch by using coated elastic yarns comprising elastic yarns and synthetic fibers, is characterized in that: the wale number in the circumferential direction is 340-400 wale; the size ratio is 1.10-1.40.

11 Claims, 1 Drawing Sheet

(51) Int. Cl.

| | |
|---|---|
| ***A41B 9/02*** | (2006.01) |
| ***A41B 9/04*** | (2006.01) |
| ***D04B 1/18*** | (2006.01) |
| ***D04B 1/24*** | (2006.01) |
| ***A41B 11/00*** | (2006.01) |

(52) U.S. Cl.
CPC ..... *A41B 11/14* (2013.01); *D04B 1/18* (2013.01); *D04B 1/243* (2013.01)

(56) References Cited

U.S. PATENT DOCUMENTS

| | | | | |
|---|---|---|---|---|
| 10,060,055 | B2 * | 8/2018 | Fukui | A41B 11/003 |
| 2016/0138203 | A1 * | 5/2016 | Akita | D04B 1/18 66/202 |
| 2019/0003087 | A1 * | 1/2019 | Matsumoto | D04B 1/04 |
| 2019/0230998 | A1 * | 8/2019 | Yoshida | D04B 1/16 |
| 2019/0233990 | A1 * | 8/2019 | Yoshida | D04B 21/18 |

FOREIGN PATENT DOCUMENTS

| | | | |
|---|---|---|---|
| JP | H05-302204 | A | 11/1993 |
| JP | H06-081207 | A | 3/1994 |
| JP | 2003-293201 | A | 10/2003 |
| JP | 2008-179925 | A | 8/2008 |
| JP | 2011-115571 | A | 6/2011 |

OTHER PUBLICATIONS

International Search Report issued in corresponding International Patent Application No. PCT/JP2017/036862 dated Nov. 28, 2017.
International Preliminary Report on Patentability and Written Opinion issued in corresponding International Patent Application No. PCT/JP2017/036862 dated Apr. 16, 2019.

* cited by examiner

LEG PRODUCT

FIELD

The present invention relates to a leg product which can provide a cool feeling when worn in a hot environment.

BACKGROUND

Conventionally, leg products which cover from the crotch to the ankle or toe such as cool pantyhose or leggings using elastic yarns prevent a feeling of humidity by using moisture-absorbing synthetic fibers such as polyamide fibers. Leg products using a special, modified cross-section polyamide fiber yarn to obtain a cooling sensation (refer to, for example, Patent Literature 1 below) and leg products in which a cooling sensation is imparted by the use of a fully dull yarn (refer to, for example, Patent Literature 2 below) are commercially available. In these leg products, though a cool feeling is imparted when worn in seasons which are only slightly hot, such as early summer, there is a problem in that such leg products, when worn in an environment in which perspiration will be generated after wearing for a long time or during exercise such as walking, can become extremely uncomfortable due to heat and perspiration, and such leg products are not suitable for hot conditions such as during the mid-summer.

CITATION LIST

Patent Literature

[PTL 1] Japanese Unexamined Patent Publication (Kokai) No. 6-81207

[PTL 2] Japanese Unexamined Patent Publication (Kokai) No. 2003-293201

SUMMARY

Technical Problem

In light of the technical problems of the leg products of the prior art described above, the object of the present invention is to provide a leg product which can provide a cool feeling when worn in a hot environment such as during the mid-summer, even when performing exercise such as walking, without the use of a special yarn.

Solution to Problem

As a result of rigorous investigation in order to achieve the object described above, the present inventors have discovered that by providing a tubular knitted fabric constituting a leg part having a desired knitted fabric structure, a cool feeling can be imparted when the leg product is worn in a hot environment and have achieved the present invention based on such discovery. The leg product according to the present invention can provide a cool feeling when worn in a hot environment without the use of a heteromorphic polyamide fiber or a fully-dull fiber, and without applying a special cooling treatment such as xylitol processing.

Specifically, the present invention is as described below.

[1] A leg product having a circumferential-direction wale number of 340 to 400-wale and comprising a tubular knitted fabric having a leg part in which all of the courses thereof have a plain stitch organization of covered elastic yarns composed of elastic yarns and synthetic fibers, wherein a size ratio as obtained by the following Formula (1):

size ratio=(width-direction elongation of the leg part at a position ¼ from a crotch under a load of 3 kg)/(width-direction elongation of the leg part at a position ¾ from the crotch under a load of 3 kg)

is 1.10 to 1.40, and a stress ratio as obtained by the following Formula (2):

stress ratio=(return path stress (*N*) at a 50% point)/(forward path stress (*N*) at the 50% point)

is 0.35 to 0.60 when the forward path stress and the return path stress are measured at the 50% point of a third repetition of an elongation/contraction process that is repeated three times, the elongation/contraction process comprising elongating the knitted fabric by 80% in the warp direction at a position ½ from the crotch of the leg part and allowing the knitted fabric to return to an original length.

[2] The leg product according to [1], wherein an average coefficient of friction of the leg part at a position ½ from the crotch in the warp direction of the knitted fabric is not greater than 0.250.

[3] The leg product according to [1] or [2], wherein the covered elastic yarns have a fineness of 13 to 30 dtex and are composed of elastic yarns and polyamide fibers, and an instant heat generation temperature of a surface of the knitted fabric is not greater than 0.40° C. after the knitted fabric has been elongated 500 times to an elongation amount of 110% with respect to an initial length at a position ½ from the crotch of the leg part in the warp direction of the knitted fabric using a repeat expansion/contraction device at a repeat expansion/contraction cycle of 100 repetitions/min as measured by thermography with an emissivity of 1.0.

[4] The leg product according to any one of [1] to [3], wherein a width-direction stretch length at a position ¼ from the crotch of the leg part under a load of 3 kg is represented by the following Formula (3):

width-direction stretch length (cm)=circumferential-direction wale number×0.11 to 0.14.

[5] The leg product according to any one of [1] to [4], wherein a portion corresponding to a thigh part of a position ¼ from the crotch of the leg part has a course number of 23 to 30 courses/inch under a load of 3 kg.

Advantageous Effects of Invention

The leg product of the present invention is cool when worn, is cool even during exercise such as walking, and is suitable to be worn in hot mid-summer heat environments.

DESCRIPTION OF EMBODIMENTS

Figure 1:
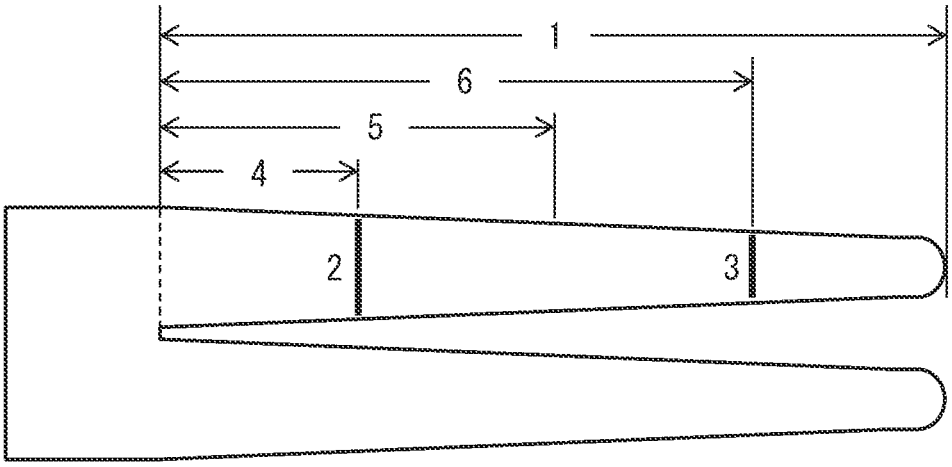
FIG. 1 is an explanatory view of positions for measuring the size ratio and stress ratio of a leg product according to the present embodiment.

The leg product according to an embodiment of the present invention (hereinafter referred to as "present embodiment") is a leg product in which a leg part thereof is a tubular knitted fabric using covered elastic yarns composed of non-elastic yarns and elastic yarns produced using a single circular-knitting machine having a small caliber of about 4 to 5 inches in diameter (also referred to as a pantyhose knitting machine), wherein all of the courses of the leg part have a plain stitch organization using the covered elastic yarns. Note that for the purpose of reinforcement and the like, an organization of separately prepared fibers can be used, or a knit organization can be mixed with a tack organization or wale organization.

In the present embodiment, in order to impart a cool feeling when worn, the knitted fabric is designed such that the "leg" of the human body and the leg product are in close contact with each other when the leg product is worn, and the apparent surface area of the leg increases so that the heat radiation area of the leg surface of the leg also increases, whereby a cool feeling is imparted when worn and the coolness lasts immediately after wearing. Thus, the pressure balance between the portion corresponding to the human "thigh part" of the leg product and the portion corresponding to the human "calf" becomes important at the time of wearing, and as a result, the coolness lasts when movement is minimized, but during exercise such as walking where more heat is generated by the human body, heat dissipation by the knitted fabric design alone cannot keep up with the increase in temperature. In order to impart a cool feeling during exercise, the knitted fabric is additionally designed such that heat dissipation from the leg product becomes possible during exercise. For this purpose, the stress ratio of the portion corresponding to the human knee is important.

In the leg product of the present embodiment, in order to obtain a cool feeling at the time of wearing, it is only necessary to increase the amount of heat dissipation from the "leg" of the human body, and thus, it has been found that when the fibers are brought into close contact with the "leg" and the apparent surface area of the "leg" is increased, heat is transferred from the "leg" to the fibers, and subsequently heat dissipates from fibers, whereby heat dissipation becomes greater than in the case of bare skin. Thus, the density of the knitted fabric is important. When the density is too high, the heat dissipation becomes small and the leg product heats up and maintains heat, rather than cooling. Conversely, when the density is too low, the increase in the apparent surface area of the "leg" is small, and heat dissipation does not occur. This density is generally expressed by a course number and a wale number. The inventors of the present invention have found as a result of intensive investigations that wale number is of particular importance. Specifically, in the tubular knitted fabric of the leg product of the present embodiment, the density in the circumferential direction is preferably 340 to 400-wale. The leg product has a wale number sufficient to facilitate ease of wearing, depending on the dimensions of the wearer. A wale number of 340 to 380-wale is used to produce a small size leg product, and a wale number of 380 to 400-wale is used to produce a large size leg product, whereby a leg product having a good wearing feeling can be produced. The wale number setting of the tubular knitted fabric can be adjusted by setting the number of needles of the knitting machine. For example, in order to produce a knitted fabric having a wale number of 352-wale, a knitting machine having 352 needles can be used.

Furthermore, in order to obtain a cooler feeling, the fineness of the covered elastic yarns used is preferably 13 to 30 dtex (decitex; the same applies hereinafter), and more preferably 13 to 25 dt. The fineness of the elastic yarns is equal to the fineness of the non-elastic yarns in a covered or twisted state. More specifically, the weight of covered elastic yarns of a certain length is weighed, and the fineness is then obtained by measuring the length after the application of a load of 10 g. The fineness may be 13 to 30 dt, and more preferably 13 to 25 dt.

Furthermore, the surface area of the "leg" of the human body is important in order to obtain a cooling leg product, and it is only necessary to set the wale number in the circumferential direction of the leg product to a specific range. Further, it has been found that the influence of the pressure on the "leg" of the human body by the leg product when worn is also important. In general, it is known that as the pressure of a garment on the leg increases, the warmth of the garment increases. Thus, even if the wale number of the leg product is within a specified range, a leg product that adheres tightly to the "leg" is likely to be considered warm. Regarding a knitted fabric design that does not get warm as the apparent surface area increases, in particular, as a result of examining the heat dissipation effect of each part of the "leg", it has been found that maximizing the heat dissipation of the thigh part had the greatest effect on the amount of heat dissipation, and it has been found that the heat dissipating effect of the calf part is small. As a result of examining the design of a leg product that best exhibits a heat dissipation effect at the thigh part thereof, by changing the sizes of the loops of the portion of the "thigh part" of the human body and the portion corresponding to the "calf" of the human body, a size balance which maximizes the heat dissipation effect of thigh part has been found. Naturally, heat is also dissipated by the calf part, but in a leg product in which the wale number in the circumferential direction is specified, the calf part is sacrificed slightly in terms of heat dissipation in favor of the thigh part. As the "leg" part, it is better to set a size balance that maximizes the heat dissipation effect within the specified ranges. Specifically, though normally the (circumference of thigh part)/(circumference of calf part) of the human body is approximately 1.4 to 1.6, differing in accordance with the size of the body, it has been found that by changing the size of the portion corresponding to the thigh part of the leg product and the size corresponding to the calf part within the specified ranges by changing the size of the loops thereof, a maximum heat dissipation effect of the "leg" part can be exhibited, whereby in addition to the thigh part, the calf part also produced a cool feeling.

In other words, in the leg product according to the present embodiment, the following three points are factors in obtaining a cool feeling:

(i) increasing the amount of heat dissipation (heat transfer from the skin, fibers to the outside environment;

(ii) minimizing heat retention as a result of the wearing of the leg product; and (iii) minimizing the heat generation of the leg product as a result of walking, etc., when the leg product is worn.

"(i) increasing the amount of heat dissipation" will be explained below.

By wearing a leg product, a convex portion of fiber is formed on the leg (skin). Regarding heat dissipation in this case, first, heat from the leg is transferred to the fiber (heat transfer), the heat moves inside the fiber to the side in contact with the external environment (air) (heat conduction), and thereafter, the heat is dissipated from the portion in contact with the external environment by transferring (heat transfer) to the external environment (air). At this time, since the area of the convex portion of fiber is larger than the area of the portion of the fiber that is in contact with the skin, the amount of dissipation from the fibers that are in contact with the skin becomes relatively larger than the amount of dissipation from the skin not in contact with the fiber (bare leg). Therefore, the amount of dissipation when wearing the leg product is (dissipation from the skin part not in contact with the fiber)+(dissipation from the fiber having a larger area than the skin area with which the fiber is in contact), whereby the amount of heat dissipation is larger than that of a bare leg (i.e., becomes cooler when the leg product is worn).

In order to maximize the heat transfer inside the fibers, and the dissipation from the fibers and the skin, a plain stitch knitting structure, which is as flat as possible, is used. When a tack or the like is introduced, air accumulates in the knitting structure, bringing about a heat retention effect. In the present embodiment, the density minimized, and the wale number in the circumferential direction is set to 340 to 400-wale. If the wale number is less than 340-wale, the dissipation effect is small, whereby the quality of the leg product is poor. Conversely, when the wale number exceeds 400-wale, the distance between the fibers and the fibers on the skin becomes smaller, whereby air can accumulate therein, bringing about a heat retention effect. Further, in a preferred form, the fineness of the fibers of the leg product is minimized. In other words, the fineness of the covered elastic yarns is set to 13 to 30 dtex. When the fineness is less than 13 dtex, the strength of the leg product is reduced. Conversely, when the fineness exceeds 30 dtex, the heat retention effect increases. Furthermore, in the present embodiment, the size ratio is optimized. Though it is preferable that the leg product be produced with the optimum density from the thigh part to the calf part, since the number of needles (wale number) of the knitting machine is constant, the course number may be changed so as to maximize heat dissipation. Though adjustment of the thigh part is easy, adjustment at the calf part is difficult. Conversely, if the wale number is optimal for the calf part, a knitting machine having a considerably coarse gauge is necessary, whereby when knitting to the thigh part using such a knitting machine, the strength and quality of the leg product become poor. The inventors of the present application have discovered as a result of examining the influence of each part of the leg on cooling sensation that since the thigh part produces the coolest feeling, size ratio is important in a design in which the calf part is sacrificed to some extent while taking full advantage of the heat dissipation effect of the thigh part so that the calf part does produce a heat retention effect and produces a cool feeling. Furthermore, in the present embodiment, a polyamide fiber having a high thermal conductivity is used.

Next, "(ii) minimizing heat retention as a result of the wearing of the leg product" will be described.

As described above, by optimizing the density, fineness, and size ratio, in the present embodiment, it is possible to minimize the accumulation of air having a high heat retaining effect between fibers, and as a result, the heat retention effect can be minimized.

Next, "(iii) minimizing the heat generation of the leg product as a result of walking, etc., when the leg product is worn" will be described.

The elastic yarns used in the leg product repeatedly generate heat due to elongation and release heat upon relaxation, whereby heat accumulates since the amount of heat released is less than the amount of heat generated during this repeated elongation and relaxation, and as a result, the leg product itself generates heat. The index that captures this heat generation is the stress ratio, and when the stress ratio is low, the leg product becomes warm when worn. Therefore, the heat generation is captured by the stress ratio, and adjustment thereof is possible due to the draft ratio of covered elastic yarns. The stress ratio is high if the leg product is more likely to return to the original length after elongation. Furthermore, by increasing slipperiness by means of a silicone treatment and setting the average coefficient of friction of the knitted fabric in the warp direction to a specified range, even when the knitted fabric is elongated, the friction in the knitted fabric is small when returning to the original length thereof, whereby the stress ratio is improved, and the heat generation decreases.

In the present embodiment, the size ratio is obtained by the following Formula (1):

size ratio=(width-direction elongation of the leg part at a position ¼ from a crotch under a load of 3 kg)/(width-direction elongation of the leg part at a position ¾ from the crotch under a load of 3 kg).

A size ratio in the range of 1.10 to 1.40, preferably in the range of 1.15 to 1.35, leads to an increase in apparent skin area of the leg product in both the thigh part and calf part in hot environments. As described above, it is possible to adjust the size of each part by adjusting the loop length. A short loop organization, i.e., when the loop length is short, produces a small size, and a large loop organization, i.e., when the loop length is long, produces a larger size. Normal leg products may be designed such that the loop length gradually shortens from the thigh part when knitting from the thigh part, to the knee part, the calf part, then ultimately the ankle part, whereby a specified size can be obtained.

Figure 2:
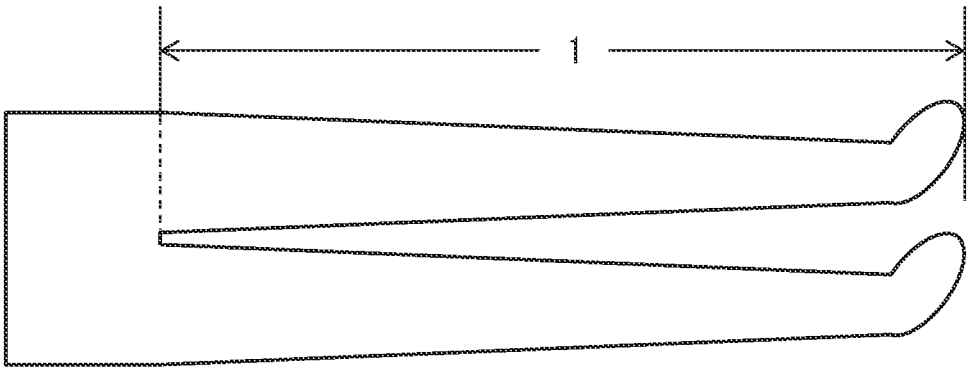
FIG. 2 is an explanatory view of positions for measuring the size ratio and stress ratio of a leg product according to the present embodiment.
Figure 3:
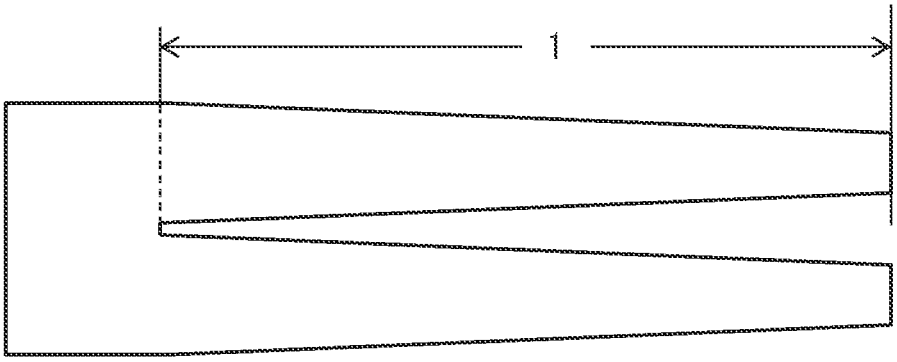
FIG. 3 is an explanatory view of positions for measuring the size ratio and stress ratio of a leg product according to the present embodiment.

Regarding the location for measurement of the size ratio, the size ratio can be obtained from Formula (1) by arranging the leg product on a workstation in an unstretched state, measuring the leg length 1 of a leg product having a sewn toe part as shown in FIG. 1 from the crotch of the base portion of both legs of the leg product to the toe part, the leg length 1 of the foot-type portion from the base portion of both legs in a foot-type leg product having a foot part as shown in FIG. 2, or in leggings without a toe as shown in FIG. 3, the length to the end of the leg around the ankle, setting this length as length 1, dividing the leg length into four equal portions, grasping both ends of the tubular knitted fabric in a tubular state at the portion in the width direction (the portion represented by numeral 2 in FIG. 1) of the leg of the position ¼ of the leg length (length represented by numeral 4 in FIG. 1) from the crotch, which is substantially equivalent to the thigh part, and the portion in the width direction (the portion represented by numeral 3 in FIG. 1) of the leg part at a position ¾ of the leg length (the length represented by numeral 6 in FIG. 1) from the crotch, which substantially corresponds to the calf part, and measuring the elongation in the width direction under a load of 3 kg. The size ratio is obtained by rounding off the third digit after the decimal point.

Further, though the size ratio is obtained with a width-direction elongation under a load of 3 kg at a position ¼ from the crotch of the leg part and a width-direction elongation under a load of 3 kg at a position ¾ from the crotch of the leg product, the size ratio is set primarily to maximize the heat dissipation effect of the calf part. In order to maximize the heat dissipation effect of thigh part, it is more effective to minimize the content of accumulated air to the greatest degree possible when the leg product is worn. Thus, in order to achieve this object, the width direction stretch length under a load of 3 kg at a position ¼ from the crotch of the leg product should be in the range f the following Formula (3):

width direction strength length ($c$)=circumferential direction wale number×0.11 to 0.14 (3)

If the stretch length in the width direction is smaller than the wale number×0.11 in the circumferential direction of the leg product, the leg product becomes significantly tight, whereby the feeling of pressure becomes excessive. If the stretch length in the width direction is greater than the wale number of the leg product in the circumferential direction× 0.14, it is unlikely that the leg product will tightly fit the leg, whereby an air layer will accumulate, causing heat generation. Thus, a cool leg product can be obtained by setting the stretch length in the width direction to the circumferential direction wale number×0.11 to 0.14, preferably 0.12 to 0.13. Note that, though the stretch length in the width direction is in the range of 37.4 to 56.0 cm within the range of the present invention, in order maximize the heat dissipation effect, it is preferable to maintain within a range of the wale number in the circumferential direction×0.11 to 0.14.

Furthermore, in the leg product of the present embodiment, it is critical that the leg product not generate heat even during exercise, since extreme discomfort is experienced if the leg product generates heat due to exercise such as walking when worn in a hot environment. Thus, it is necessary to adjust the stress ratio, which is known to greatly affect heat generation during exercise. In other words, it is preferable that the stress ratio, which is obtained from the following Formula (2):

stress ratio=(return path stress (*N*) at a 50% point)/
(forward path stress (*N*) at the 50% point)

by sampling the knitted fabric at a position ½ of the leg length from the crotch (represented by numeral 5 in FIG. 1), which substantially corresponds to the knee part, repeatedly elongating the knitted fabric by 80% in the warp direction and thereafter allowing the knitted fabric to return to its original length for a total of three repetitions, and measuring the forward path stress at a 50% point and the return path stress at a 50% point of the contraction process, be in the range of 0.35 to 0.60, more preferably 0.40 to 0.60. Note that the stress ratio is obtained by rounding off the third digit after the decimal point.

In normal leg products, the stress ratio is 0.2 to 0.3. However, the stress ratio of the leg product of the present embodiment has a high numerical value, and heat is unlikely to be generated during exercise. Adjustment of the stress ratio is possible by adjusting the yarn length ratio, which is also referred to as the "draft ratio", of the elastic yarns of the covered elastic yarns to the synthetic fibers. When the thread length ratio is decreased, the stress ratio also decreases, and when the yarn length ratio increases, the stress ratio also increases. Furthermore, it is possible to adjust the stress ratio by adjusting the number of twists of the covered elastic yarns, and the stress ratio tends to decrease if the number of twists is too high or too low. Thus, the number of twists is set within the range of 1500 to 2000 T/m. As a result, the stress ratio can be adjusted by setting the yarn length ratio of the covered elastic yarns to a somewhat high value such as the range of 3.0 to 3.5, adjusting the size of the loops of the knitted fabric, using a slippery softening agent as a finishing agent, and adjusting the concentration of the silicone-based processing agent. It is also possible to adjust the stress ratio by adjusting the finish setting conditions and it is important not to make the finish setting conditions too severe. In particular, it is preferable to use a silicone-based processing agent and to set the finish setting to a temperature of 105° C. or less and a duration of 20 seconds or less.

The coefficient of friction of the leg product of the present embodiment varies depending on the fineness of the covered elastic yarns used, the number of twists of the covered elastic yarns, and the finishing agent. In order obtain a leg product which is cool even during movement in a hot environment, it is also important to eliminate discomfort due to friction between the leg product and the skin of the leg during exercise. In other words, when the friction coefficient of leg product is high, friction with the skin during exercise is significant, whereby it becomes difficult to move, and heat generation due to friction is likely to occur. Thus, the average coefficient of friction in the warp direction of the knitted fabric at a position ½ from the crotch of the leg part of the leg product of the present embodiment is preferably 0.250 or less, and more preferably 0.240 or less. When the average coefficient of friction is greater than 0.250, the leg product becomes uncomfortable during exercise when worn in a hot environment. Regarding the measurement of the coefficient of friction, though a detailed measurement method is shown in the Examples, measurement is preformed using a Tribomaster (manufactured by Trinity Labs), which can more accurately evaluate friction with the human body. The average coefficient of friction can be set to 0.250 or less by the use of a slippery processing agent, such as a silicone processing agent or the like, at a slightly high concentration in particular during finishing processing. For example, when a silicone processing agent is imparted to conventional pantyhose, an amount of 1 to 2% owf is used. In the present embodiment, an amount of 5 to 8% owf is used, whereby the stress ratio and the average coefficient of friction can be set to within the specified ranges. Furthermore, in addition to the silicone processing agent, processing agents such as polyurethane, for sweat-resistance, can be additionally added. In such a case, the leg product is comfortable, even during perspiration.

The leg product of the present embodiment can become very uncomfortable when worn during exercise due to heat generation of the leg product itself and a feeling of humidity. Since it is impossible to set the heat generation temperature at elongation to 0° C., as a result of examining the relationship between the heat generation temperature at elongation of the tubular knitted fabric and coolness, the present inventors have discovered that if the heat generation temperature at elongation is preferably 0.4° C. or less, there is no uncomfortable feeling even when the leg product is worn in hot environments. Specifically, since air movement is generated by the movement of the leg during walking, it is expected that heat will dissipate. When the heat generation temperature at elongation is greater than 0.4° C., the heat generated at the time of elongation is higher than heat released by the air movement. Thus, it is preferable to suppress the heat generation temperature of the knitted fabric to 0.4° C. or less at elongation. Though it is possible to set the heat generation temperature upon elongation of the knitted fabric due to exercise or the like to 0.4° C. or lower by setting the wale number, size ratio, and stress ratio to the specified ranges, and by using a slippery processing agent such as silicone-based processing agent, in order to obtain a comfortable leg product, it is suitable to use covered elastic yarns of polyamide-based synthetic fibers and elastic yarns as the leg part. It is believed that this is because the heat generation and the hygroscopicity of the polyamide fibers suppresses heat generation during elongation, whereby it is possible to limit the heat generation temperature upon elongation to 0.4° C. or less.

In the present description, the phrase "heat generation temperature upon elongation" is defined as a value calculated from the change in the temperature of the knitted fabric before and after a test in which the maximum temperature exhibited by the knitted fabric is measured by thermography when the tubular knitted fabric as-is is folded in two in the warp direction (length direction), the knitted fabric having four stacked layers is grasped the top and bottom of the knitted fabric, and elongation to 110% elongation followed by allowing the fabric to return to its the original length is repeated for a total of 500 repetitions at a speed of 100 repetitions/min under conditions where heat is not supplied from outside and the generation temperature upon elongation is not changed by wind.

If the temperature of the knitted fabric after 500 repetitions of expansion and contraction becomes higher than the temperature knitted fabric before the start of the test, this indicates that heat is generated during elongation. It is preferable that the heat generation temperature upon elongation of the knitted fabric of the leg product of the present embodiment measured by this method be 0.4° C. or less. A knitted fabric which generates a heat greater than 0.4° C. is uncomfortable as a result of a humid feeling when worn a hot environment or during exercise. Thus, the heat generation temperature upon elongation is preferably 0.4° C. or less, more preferably 0.3° C. or less. Note that the heat generation is observed by thermography, and the heat generation temperature upon elongation is rounded to the second decimal point.

The leg product of the present embodiment can be manufactured by a small diameter cylindrical knitting machine such as a pantyhose knitting machine having a number of needles of 340 to 400. Regarding the knitting organization, a plain stitch is preferable, whereby the leg product closely adheres to the skin when worn, and as a result, the apparent surface area can be increased, and additionally, upon bending and stretching during exercise, the leg product can quickly recover, whereby the heat generation temperature upon elongation can be minimized.

Though the leg part of the leg product of the present embodiment is constituted by covered elastic fibers, the covered elastic yarns can also be constituted by SCY and DCY covered yarns or twisted yarns, in which synthetic fibers are wound around the elastic yarns. Further, it is necessary that the covered elastic yarns be contained in all of the courses of the leg part of the leg product, whereby when interwoven with the non-elastic yarns, a high heat generation temperature upon elongation is unlikely to occur.

Though the leg product of the present embodiment is characterized by a slightly small wale number in order to increase the amount of heat absorption, depending on the wearing state, the loops of the leg product may become deformed, whereby variations in the density may occur, causing aesthetic distortion of the knitted fabric of the leg product, and as a result, poor aesthetic properties. As a result of examining the aesthetic properties of the leg product, it was discovered that leg products with good aesthetics could be produced in particular by setting the density of the thigh part, in which the aesthetics can be easily understood, to an appropriate range. In other words, by setting the course number of the portion corresponding the thigh part at a position ¼ from the crotch of the leg part to 23 to 30 courses/inch under a load of 3 kg, aesthetic distortion of the knitted fibric is unlikely to occur, whereby a leg product having good aesthetic properties is obtained. Note that if the course number is less than 23 courses/inch, the effect of heat dissipation is reduced, whereby the leg product becomes tight, and when the course number is more than 30 courses/inch, aesthetic distortion occurs, whereby the aesthetic properties of the leg product are poor.

The method for measuring the course number of the portion corresponding to the thigh portion is described in the Examples.

The elastic yarns used in the leg product of the present embodiment can be polyurethane-based or polyetherester-based elastic yarns. For example, dry-spun or melt-spun yarns can be used as the polyurethane-based elastic fibers. The polymer and the spinning method are not particularly limited. Elastic yarns having an elongation at break of 400% to 1000% which are excellent in stretchability and which do not have impaired elasticity at a temperature in the vicinity of the normal temperature of 180° C. in a presetting step during dyeing are preferable.

Furthermore, elastic yarns that have been given properties such as high setting properties, antibacterial properties, moisture absorption properties, water absorption, etc., by the addition of special polymers or powders can be used as the elastic yarns. The fineness of the elastic yarns is preferably in the range of 10 to 25 dtex.

Further, in the leg product of the present embodiment, inorganic substances can be included in the elastic yarns, and the knitted fabric can be used in consideration of the performance of the included inorganic substances. For example, when titanium oxide is included, the knitted fabric can have excellent thermal conductivity and good heat dissipation properties. When an inorganic substance providing good hygroscopicity is included, the leg product has good hygroscopicity, whereby a humid feeling can be prevented.

As the method for incorporating an inorganic substance, it is simple to incorporate the inorganic substance into the spinning stock solution of the elastic yarns prior to spinning. In the present description, "inorganic substance" refers to any simple inorganic substance and/or inorganic compound of ceramics such as titanium oxide, and the inorganic substance is preferably in the form of a fine powder so as not to hinder the spinning of the elastic yarns. These inorganic substances are preferably included in an amount of 1 to 10 wt %. If the amount of inorganic substance is excessively small, the cooling effect or the like is small, and if the amount of inorganic substance is excessive, the yarn becomes likely to break upon elongation or during spinning. Thus, a content of 1 to 10 wt % is preferable, and a content of 2 to 5 wt % is more preferable.

Though polyester fibers such as polyethylene terephthalate and polytrimethylene terephthalate fibers, polyamide fibers, and polyolefin fibers such as polypropylene fibers can be used as the synthetic fibers, it is preferable that polyamide-based synthetic fibers be used. Furthermore, these brilliant, semi-dull, or fully-dull yarns can be arbitrarily used, and though the cross-sectional shape of fibers may be any cross-sectional shape such as a round shape, elliptical shape, W-shape, or cocoon-shape, or hollow fibers can be used, the shape of the fibers is not particularly limited. Though a crimped yarn such as a raw yarn or false-twist yarn can be used, a raw yarn, which provides an excellent cool feeling and hygroscopicity, is preferable. As the synthetic fibers, non-elastic yarns having a fineness of 5 to 20 dt, preferably 8 to 15 dt can be appropriately used.

A knitted fabric which is excellent in heat dissipation, moisture absorption, and sweat absorption properties can be produced by including synthetic fibers containing 0.3 to 5 wt % of an inorganic substance such as titanium oxide and an agent which is excellent in moisture absorption.

As the method of dyeing and finishing the leg product of the present embodiment, a conventional dyeing finishing process can be used, and the dyeing conditions can be set in accordance with the fiber material to be used. The dyeing machine to be used is also arbitrary, and may be a paddle dyeing machine or a drum dyeing machine. A processing agent for improving water absorption and flexibility and a processing agent for enhancing cooling feeling can also be used. Regarding the finish setting, it is preferable that heat not be applied to the knitted fabric, and conditions of a temperature of 105° C. or less and a duration of 20 seconds or less are preferable.

The leg product of the present embodiment is preferably in the form of pantyhose or leggings, and can also be used as sportswear such as sports tights and compression tights and other sportswear, such as underwear bottoms, etc. The leg product of the present embodiment is a leg product which is cool when worn in hot environments.

EXAMPLES

The present invention will be more specifically described below by way of the Examples. However, the present invention is not limited to only these Examples. The evaluation methods used in the Examples are as described below.

(1) Size Ratio

Leg length is measured by placing the leg product on a workstation in an unstretched state and measuring the length from the crotch of the base portion of both legs of the leg product, which is represented by reference numeral 1 in FIG. 1, to, in a leg product having a toe, the toe, and in leggings or the like without a toe, to the end of the leg around the ankle, and this length is divided in four equal portions to obtain the position at ¼ length from the crotch (the length represented by reference numeral 4 in FIG. 1) and the position ¾ length from the crotch (the length represented by reference numeral 6 in FIG. 1). The elongation is measured by gripping both ends of the tubular knitted fabric in the width direction at each position in a tubular state with gripping parts having a diameter of 10 mm, and applying a load of 3 kg between the gripping parts. The width direction elongation at the positions indicated by reference numerals 2 and 3 of FIG. 1 are measured by this method, and the size ratio is obtained by the following Formula (1):

size ratio=(width-direction elongation of the leg part at a position ¼ from a crotch under a load of 3 kg)/(width-direction elongation of the leg part at a position ¾ from the crotch under a load of 3 kg)

The third digit after the decimal point is rounded off when calculating the size ratio.

(2) Stress Ratio

At the position ½ from the crotch of the leg length measured in (1), sampling is performed under with the following criteria, and only the warp direction (length direction) is measured.

Sample size: length: 100 mm (excluding gripping part)

width: tubular knitted fabric as-is is folded three-times in the warp direction (length direction) and gripped by gripping parts Tensile Tester: Tensilon Tensile Tester (manufactured by Orientech Corp.; RTC-1210A)

Width of Gripping Part: 60 mm

Initial Load: 0.1 N

Tensile Speed and Recovery Speed: 300 mm/min

Tensile length and measure: elongation to 80% elongation, after elongation at the same speed, the leg product returns (is restored) to the original length, elongation and recovery are repeated three times under these conditions, and the forward path stress and return path stress at the 50% point during elongation/contraction in a third repetition are obtained. The stress ratio is calculated, rounding off the third digit after the decimal point, by the following Formula (2):

stress ratio=(return path stress (*N*) at a 50% point)/(forward path stress (*N*) at the 50% point)

(3) Average Coefficient of Friction

The average coefficient of friction is measured by sampling the following sizes and measuring in only the warp direction (length direction) under the following conditions at the position ½ from the crotch of the leg length measured in (1).

Measurement Device: Tribomaster Type TL201 Ts (manufactured by Trinity Labs)

Contacts: finger model contact; no pattern

Load: 3.75 g

Moving speed: 30 mm/sec

Friction distance: 50 mm

Sample size: 100 mm in length as tubular (excluding gripping part)

Measurement: the sampled tubular knitted fabric is placed as-is on a measurement table and one side is rubbed with the contact.

(4) Heat Generation Temperature Upon Elongation

Sampling is performed at the following sizes, and the warp direction (length direction) only is measured at a position ½ from the crotch of the length measured in (1).

Sample size:

Length: 100 mm (excluding gripping part)

Width: the tubular knitted fabric as-is is folded in half in the warp direction and grasped with gripping parts (knitted fabric becomes four layers)

Repeat Elongation Machine: Demacher testing machine (manufactured by Daiei Scientific Seiki Seisakusho Co., Ltd.)

Measurement Environment: constant temperature and humidity conditions with a temperature 20° C. and a humidity 65% RH. In addition to expansion and contraction, measurements are taken in a state in which external energy is not supplied.

Elongation amount: 110% with respect to the initial length (since the initial length is 100 mm, the gripping parts are expanded, and the distance between the gripping parts is increased to 210 mm)

Repeat cycles: 100 cycles/minute

Heat Generation Temperature Measurement: the sample surface temperature is measured continuously and thermographically during 500 repeat elongation and contraction cycles. The emissivity of the thermography is set to 1.0.

Heat Generation Temperature Evaluation: the temperature of the sample surface to be measured at the highest temperature is read, and the temperature increase compared to the temperature prior to expansion is taken as the instantaneous heat generation temperature.

(5) Heat Generation when Worn

The obtained leg product is worn under conditions of 30° C. and 50% RH, and walking is performed using a treadmill for 3 minutes at 5 km/hr. The surface temperature of the leg from the thigh part to the ankle before and after walking is observed from the front of the human body with a thermograph set at an emissivity of 1.0, an average temperature before and after walking is obtained by image analysis, and the amount of change from the average temperature of the entire leg before walking is obtained by the following formula. When the temperature of the heat generation when worn is −0.5° C. or more, the leg product is considered cool even in hot environments. In the temperature analysis, the second digit of the decimal point of the heat generation when worn is rounded off Though it is known that the heat generation temperature decreases at the skin surface as blood flow on the skin surface goes into the muscle during early stages of walking, and the muscles also generate heat as a result of walking for a long time, whereby the skin temperature also gradually increases, walking was performed for 3 minutes so as to minimize the influence of muscular heat generation caused by walking. Although skin temperature is decreased after walking as compared to before walking also in comparative example which is outside the scope of the invention, it can be said that the more decrease in skin temperature, the cooler feeling when exercising.

Temperature of Heat Generation When Worn=(Thigh Part Temperature Prior to Walking)−(Thigh Part Temperature After Walking)

(6) Thigh Part Course Number Measurement Method

The length from the crotch of the base portion of both legs of the leg product, which is represented by numeral 1 in FIG. 1, to the toe of the leg product having a toe, or in leggings or the like which do not have a toe, the leg length to the end of the leg product around the ankle measured when the leggings is placed on a workstation in an unstretched state, is measured, and the knitted fabric, which is tubular and which is gripped at a grip interval of 5 cm before and after (10 cm in total) the position of ¼ length from crotch (represented by numeral 4 in FIG. 1) by dividing the length measured above into four equal parts, is grasped with a width of 2.5 cm at the top and the bottom, and the course number between a 1 inch length in the length direction is applied with a load of 3 kg applied thereto. Three or more locations in circumferential direction of the leg product are measured, and the average thereof, rounding off the decimal, is the course number of thigh part. If the knitted fabric breaks under a load of 3 kg, measurement is performed under a load slightly less than the load of breaking.

(7) Thigh Part Aesthetic

The leg product is worn and the aesthetic due to the loop density is evaluated based on the following criteria. An evaluation of Good or Fair indicates no problems due to aesthetic.

Good: No noticeable differences in density; pleasant appearance

Fair: Some noticeable differences in loop density; not substantial

Poor: Significant density differences, whereby appearance is poor; alternatively, tight and pressure is too significant.

Example 1

A 21 dtex covered elastic yarn was formed by covering a 22 dtex elastic yarn (product name: Roica SF; manufactured by Asahi Kasei Corporation) with a 13 dtex/7 filament polyamide fiber yarn, wherein the draft rate of the elastic yarns was 3.0 and the number of twists was 1700 T/m. Knitting was performed from the portion corresponding to the waist part of pantyhose to the toe with a pantyhose knitting machine having a stitch number of 352 using this covered elastic yarn by adjusting the sizes of the loops between the thigh part and the calf part so that size ratio, width direction stretch length, and thigh part course number listed in Table 1 were obtained. The portion corresponding to the panty portion was knitted by alternating the covered elastic yarn and a 78 dtex/24 filament polyamide fiber processed yarn, knitting was performed from the crotch to the toe portion while gradually decreasing the size of the loops of only the covered elastic yarn, and the panty part and the toe part were sewn using two of the produced knitted fabrics. Thereafter, this was introduced into a paddle dyeing machine, the polyamide fiber was dyed, and at the end of the dyeing process, 5% owf of a silicone-based processing agent (Mei Silicone ASE68 (manufactured by Meisei Chemical Industry Co., Ltd.)) was added to the paddle dyeing machine, and treatment was carried out for 5 minutes at room temperature. After 5 minutes had elapsed, the pantyhose was removed from the paddle dyeing machine, and after dehydration and drying, the pantyhose was set in a leg-type metal frame, and setting was carried out at 100° C. for 10 seconds, whereby a pantyhose having a wale number in the circumferential direction of 352-wale was obtained. The size ratio, stress ratio, and exothermic temperature upon elongation of the produced pantyhose were measured. As a result of the coolness examination according to the wearing test, the obtained pantyhose was cool when worn. In particular, the temperature decrease of the legs after exercise was large, whereby the pantyhose was considered to be cool even when worn in a hot environment. The results are shown in Table 1 below.

Examples 2 to 5 and Comparative Examples 1 and 2

Pantyhose were produced in the same manner as Example 1 except that the size ratio was changed by adjusting the sizes of the loops of the thigh part and the calf part (Examples 2 and 3 and Comparative Example 1), pantyhose were obtained in the same manner as Example 1 except that the course number of the thigh part was changed (Examples 8 and 9 and Comparative Example 4), and pantyhose were obtained in the same manner as Example 1 except that the concentration of the silicone processing agent was changed to 8% owf (Example 4), 3% owf (Example 5), and 1% owf (Comparative Example 2). Wearing evaluation was performed, and the results are shown in Table 1.

Example 6

A 15 dtex covered elastic yarn was formed by covering a 19 dtex elastic yarn (product name: Roica BC; manufactured by Asahi Kasei Corporation) with an 8 dtex/5 filament polyamide fiber yarn, wherein the draft rate of the elastic yarns was 3.0 and the number of twists was 1900 T/m. Knitting was performed from the portion corresponding to the waist part of pantyhose to the toe with a pantyhose knitting machine having a stitch number of 368 using this covered elastic yarn. The portion corresponding to the panty portion was knitted by alternating the covered elastic yarn and a 78 dtex/24 filament polyamide fiber processed yarn, knitting was performed from the crotch to the toe portion while gradually decreasing the size of the loops of only the covered elastic yarn, and the panty part and the toe part were sewn using two of the produced knitted fabrics. Thereafter, the pantyhose was introduced to a drum dyeing machine and the polyamide fiber was dyed. At the end of the dyeing process, 6% owf of a silicone-based processing agent (Mei Silicone ASE68 (manufactured by Meisei Chemical Industry Co., Ltd.)) was added to a paddle dyeing machine, and treatment was carried out for 5 minutes at room temperature. After 5 minutes had elapsed, the pantyhose was removed from the paddle dyeing machine, and after dehydration and drying, the pantyhose was set in a leg-type metal frame, and setting was carried out at 100° C. for 10 seconds, whereby leggings ending at the ankle having a wale number in the circumferential direction of 368-wale was obtained. The size ratio, stress ratio, and exothermic temperature upon elongation of the produced leggings were measured. As a result of the coolness examination according to the wearing test, the obtained leggings were cool when worn. In particular, the temperature decrease of the legs after exercise was large, whereby the pantyhose was considered to be cool even when worn in a hot environment. The results are shown in Table 1 below.

Example 7

A 25 dtex covered elastic yarn was formed by covering a 22 dtex elastic yarn (product name: Roica SF; manufactured by Asahi Kasei Corporation) with a 17 dtex/5 filament polyamide fiber yarn, wherein the draft rate of the elastic yarns was 3.0 and the number of twists was 500 T/m. Knitting was performed from the portion corresponding to the waist part of pantyhose to the toe with a pantyhose knitting machine having a stitch number of 341 using this covered elastic yarn. The portion corresponding to the panty portion was knitted by alternating the covered elastic yarn and a 78 dtex/24 filament polyamide fiber processed yarn, knitting was performed from the crotch to the toe portion while gradually decreasing the size of the loops of only the covered elastic yarn, and the panty part and the toe part were sewn using two of the produced knitted fabrics. Thereafter, the pantyhose was introduced to a drum dyeing machine and the polyamide fiber was dyed. At the end of the dyeing process, 6% owf of a silicone-based processing agent (Mei Silicone ASE68 (manufactured by Meisei Chemical Industry Co., Ltd.)) was added to a paddle dyeing machine, and treatment was carried out for 5 minutes at room temperature. After 5 minutes had elapsed, the pantyhose was removed from the paddle dyeing machine, and after dehydration and drying, the pantyhose was set in a leg-type metal frame, and setting was carried out at 100° C. for 10 seconds, whereby leggings ending at the ankle having a wale number in the circumferential direction of 341-wale was obtained. The size ratio, stress ratio, and exothermic temperature upon elongation of the produced leggings were measured. As a result of the coolness examination according to the wearing test, the obtained leggings were cool when worn. In particular, the temperature decrease of the legs after exercise was large, whereby the pantyhose was considered to be cool even when worn in a hot environment. The results are shown in Table 1 below.

Comparative Example 3

Leggings having a wale number in the circumferential direction of 420-wale were produced under the same conditions and in the same manner as Example 6, except that a pantyhose knitting machine having a stitch number of 420 was used. The results are shown in Table 1 below.

TABLE 1

| Sample | Size Ratio | Stress Ratio | Average Coefficient of Friction | Heat Generation Temperature Upon Elongation (° C.) | Heat Generation Temperature When Worn (° C.) | Width Direction Stretch Length (cm) | Thigh Part Course Number | Wearing Feel | Thigh Part Aesthetic |
|---|---|---|---|---|---|---|---|---|---|
| Example 1 | 1.31 | 0.49 | 0.211 | 0.31 | −0.9 | 42.5 | 25 | Cool | Good |
| Example 2 | 1.35 | 0.43 | 0.218 | 0.27 | −1.2 | 46.9 | 27 | Cooler Than Bare Leg | Fair |
| Example 3 | 1.16 | 0.46 | 0.209 | 0.38 | −0.7 | 38.3 | 24 | Cool | Good |
| Example 4 | 1.30 | 0.59 | 0.195 | 0.24 | −1.4 | 44.8 | 26 | Cooler Than Bare Leg | Good |
| Example 5 | 1.31 | 0.35 | 0.241 | 0.39 | −0.5 | 41.7 | 24 | Cool | Good |
| Example 6 | 1.33 | 0.48 | 0.199 | 0.33 | −1.1 | 47.8 | 24 | Cooler Than Bare Leg | Good |
| Example 7 | 1.22 | 0.39 | 0.231 | 0.36 | −0.8 | 43.1 | 23 | Cool | Good |
| Example 8 | 1.29 | 0.44 | 0.201 | 0.29 | −0.8 | 45.1 | 28 | Cool | Fair |
| Example 9 | 1.37 | 0.46 | 0.221 | 0.32 | −0.4 | 41.9 | 23 | Cooler Than Bare Leg | Good |
| Comp. Ex. 1 | 1.08 | 0.31 | 0.271 | 0.55 | 0.3 | 34.8 | 31 | Hot and Humid | Poor |
| Comp. Ex. 2 | 1.31 | 0.29 | 0.311 | 0.66 | 0.2 | 36.9 | 24 | Hot and Humid, Uncomfortable | Good |
| Comp. Ex. 3 | 1.41 | 0.33 | 0.309 | 0.79 | 0.1 | 56.5 | 21 | Hot and Humid, Uncomfortable | Poor |
| Comp. Ex. 4 | 1.50 | 0.61 | 0.388 | 0.71 | 0.9 | 57.9 | 18 | Hot and Humid, Uncomfortable | Poor |

INDUSTRIAL APPLICABILITY

The leg product of the present invention can be suitably used in pantyhose or leggings, can also be used for sportswear such as spats, sport tights, compression tights, or for underwear bottoms, and is cool in hot environments.

REFERENCE SIGNS LIST

1 leg length
2 size measurement part at ¼ position from crotch (inside leg)
3 size measurement part at ¾ position from crotch
4 ¼ length from crotch
5 ½ length from crotch
6 ¾ length from crotch

The invention claimed is:

1. A leg product having a circumferential-direction wale number of 340 to 400-wale and comprising a tubular knitted fabric having a leg part in which all of the courses thereof have a plain stitch organization of covered elastic yarns composed of elastic yarns and synthetic fibers, wherein a size ratio as obtained by the following Formula (1):

size ratio=(width-direction elongation of the leg part at a position ¼ from a crotch under a load of 3 kg)/(width-direction elongation of the leg part at a position ¾ from the crotch under a load of 3 kg)

is 1.10 to 1.40, and a stress ratio as obtained by the following Formula (2):

stress ratio=(return path stress (*N*) at a 50% point)/(forward path stress (*N*) at the 50% point)

is 0.35 to 0.60 when the forward path stress and the return path stress are measured at the 50% point of a third repetition of an elongation/contraction process that is repeated three times, the elongation/contraction process comprising elongating the knitted fabric by 80% in the warp direction at a position ½ from the crotch of the leg part and allowing the knitted fabric to return to an original length.

2. The leg product according to claim 1, wherein an average coefficient of friction of the leg part at a position ½ from the crotch in the warp direction of the knitted fabric is not greater than 0.250.

3. The leg product according to claim 1, wherein the covered elastic yarns have a fineness of 13 to 30 dtex and are composed of elastic yarns and polyamide fibers, and an instant heat generation temperature of a surface of the knitted fabric is not greater than 0.40° C. after the knitted fabric has been elongated 500 times to an elongation amount of 110% with respect to an initial length at a position ½ from the crotch of the leg part in the warp direction of the knitted fabric using a repeat expansion/contraction device at a repeat expansion/contraction cycle of 100 repetitions/min as measured by thermography with an emissivity of 1.0.

4. The leg product according to claim 1, wherein a width-direction stretch length at a position ¼ from the crotch of the leg part under a load of 3 kg is represented by the following Formula (3):

width-direction stretch length (cm)=circumferential-direction wale number×0.11 to 0.14.

5. The leg product according to claim 1, wherein a portion corresponding to a thigh part of a position ¼ from the crotch of the leg part has a course number of 23 to 30 courses/inch under a load of 3 kg.

6. The leg product according to claim 2, wherein the covered elastic yarns have a fineness of 13 to 30 dtex and are composed of elastic yarns and polyamide fibers, and an instant heat generation temperature of a surface of the knitted fabric is not greater than 0.40° C. after the knitted fabric has been elongated 500 times to an elongation amount of 110% with respect to an initial length at a position ½ from the crotch of the leg part in the warp direction of the knitted fabric using a repeat expansion/contraction device at a repeat expansion/contraction cycle of 100 repetitions/min as measured by thermography with an emissivity of 1.0.

7. The leg product according to claim 2, wherein a width-direction stretch length at a position ¼ from the crotch of the leg part under a load of 3 kg is represented by the following Formula (3):

width-direction stretch length (cm)=circumferential-direction wale number×0.11 to 0.14.

8. The leg product according to claim 3, wherein a width-direction stretch length at a position ¼ from the crotch of the leg part under a load of 3 kg is represented by the following Formula (3):

width-direction stretch length (cm)=circumferential-direction wale number×0.11 to 0.14.

9. The leg product according to claim 2, wherein a portion corresponding to a thigh part of a position ¼ from the crotch of the leg part has a course number of 23 to 30 courses/inch under a load of 3 kg.

10. The leg product according to claim 3, wherein a portion corresponding to a thigh part of a position ¼ from the crotch of the leg part has a course number of 23 to 30 courses/inch under a load of 3 kg.

11. The leg product according to claim 4, wherein a portion corresponding to a thigh part of a position ¼ from the crotch of the leg part has a course number of 23 to 30 courses/inch under a load of 3 kg.

* * * * *